US009348293B2

(12) United States Patent
Sato et al.

(10) Patent No.: US 9,348,293 B2
(45) Date of Patent: May 24, 2016

(54) IMAGE FORMING APPARATUS THAT CORRECTS SHEET CURL BY PRINTING ON THE EDGES OF THE REVERSE SIDE OF THE SHEET

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Yoshinori Sato, Shizuoka (JP); Shunichi Megawa, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/471,030

(22) Filed: Aug. 28, 2014

(65) Prior Publication Data

US 2016/0062298 A1 Mar. 3, 2016

(51) Int. Cl.

| | |
|---|---|
| ***G03G 15/00*** | (2006.01) |
| ***B41J 11/00*** | (2006.01) |
| ***G03G 15/23*** | (2006.01) |

(52) U.S. Cl.

CPC ..... *G03G 15/6576* (2013.01); *B41J 11/0005* (2013.01); *G03G 15/234* (2013.01)

(58) Field of Classification Search

CPC ..... G03G 15/235; G03G 15/6576; G03G 2215/00662; G03G 2215/00704; B65H 2301/5121

See application file for complete search history.

(56) References Cited

U.S. PATENT DOCUMENTS

| | | | | |
|---|---|---|---|---|
| 5,749,040 | A * | 5/1998 | Muramatsu | 399/406 |
| 7,922,317 | B2 * | 4/2011 | Nakazawa | B41J 3/60 347/101 |
| 2011/0234672 | A1 | 9/2011 | Ohtsu et al. | |
| 2012/0170064 | A1 * | 7/2012 | Hibino et al. | 358/1.9 |

* cited by examiner

*Primary Examiner* — Justin Olamit

(74) *Attorney, Agent, or Firm* — Amin, Turocy & Watson LLP; Gregory Turocy

(57) ABSTRACT

An image forming apparatus comprises a printer configured to print the display image on a first surface of paper in a case of simplex printing; a curl suppression image determination section configured to determine, in simplex printing case, a printing position and a printing pattern of a curl suppression image for suppressing the curl of the paper caused by the display image based on an analysis result of a display image analysis section which analyzes the printing range and the density of the display image for each page; and a curl-preventive image addition setting section configured to set image information of the printing position and the printing pattern of the curl suppression image which is determined by the curl suppression image determination section and is supposed to be printed on a second surface of the paper with color erasable material by the printer section.

7 Claims, 8 Drawing Sheets

FIRST SURFACE

SECOND SURFACE

IMAGE FORMING APPARATUS THAT CORRECTS SHEET CURL BY PRINTING ON THE EDGES OF THE REVERSE SIDE OF THE SHEET

FIELD

Embodiments described herein relate to a technology for preventing a reuse sheet, which has been repeatedly subjected to image printing processing with color erasable material and image erasing processing, from being curled.

BACKGROUND

Generally, in an electrophotographic type image forming apparatus, in a case of printing a toner image on a sheet for printing such as paper and the like, it is known that distortion occurs in the sheet for printing and curl is generated in the sheet for printing due to the effect of the heat applied when fixing the toner image by heating.

On the other hand, a technology has been proposed in which an image is printed with the color erasable material again on the reuse sheet obtained by erasing the image formed on the sheet for printing with color erasable material.

In an electrophotographic type image forming apparatus, in a case of forming an image on the reuse sheet with color erasable material, curl occurs in the reuse sheet easily. Thus, it is preferred to prevent the occurrence of curl during the image forming process.

DETAILED DESCRIPTION

An image forming apparatus according to the present embodiment generally relates to an image forming apparatus for printing a display image serving as a printing target for display on paper with color erasable material.

The image forming apparatus comprises a printing surface mode determination section configured to determine whether or not the display image is to be subjected to simplex printing; a printer configured to print the display image on a first surface of paper in a case of simplex printing; a curl suppression image determination section configured to determine, if it is determined to be simplex printing by the printing surface mode determination section, a printing position and a printing pattern of a curl suppression image for suppressing the curl of the paper caused by the display image based on an analysis result of a display image analysis section which analyzes the printing range and the density of the display image for each page; and a curl-preventive image addition setting section configured to set image information of the printing position and the printing pattern of the curl suppression image which is determined by the curl suppression image determination section and is supposed to be printed on a second surface of the paper with color erasable material by the printer section.

An image forming method according to the present embodiment generally relates to an image forming method for printing a display image serving as a printing target for display on paper with color erasable material.

The image forming method includes: determining whether or not the display image is to be subjected to simplex printing; analyzing a printing range and density of the display image for each page if it is determined to be simplex printing; determining a printing position and a printing pattern of a curl suppression image for suppressing the curl of paper caused by the display image based on the analysis result; printing the display image on a first surface of the paper in a case of simplex printing; printing the curl suppression image on a second surface of the paper with color erasable material according to the determined printing position and printing pattern.

Figure 1:
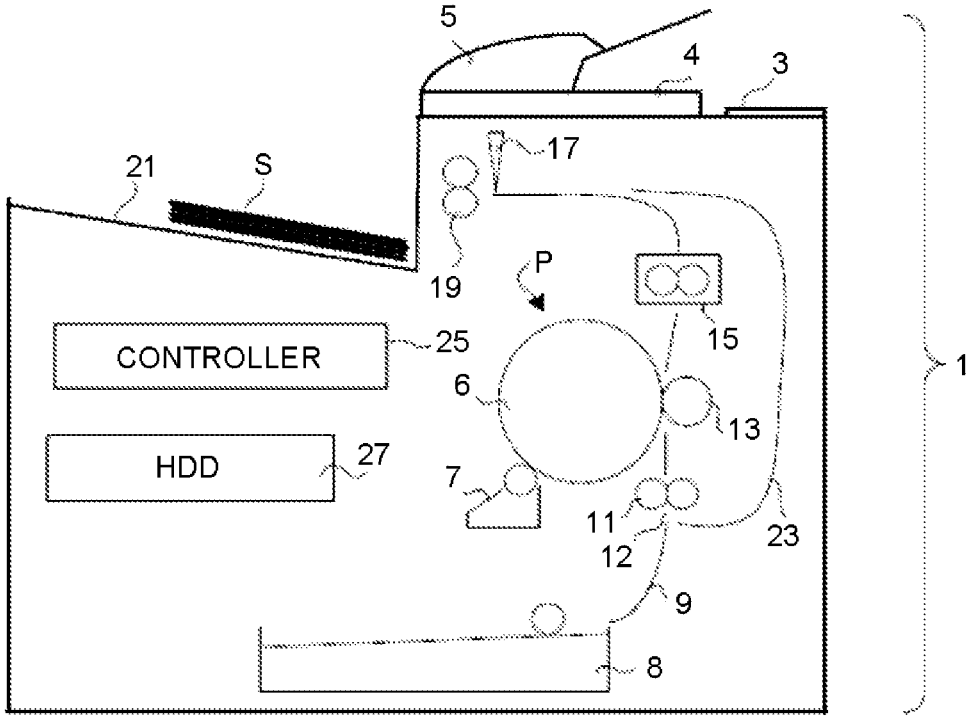
FIG. 1 is a schematic diagram illustrating an image forming apparatus according to one embodiment.

FIG. 1 is a schematic diagram illustrating the image forming apparatus according to the embodiment. An image forming apparatus 1 according to the present embodiment, which is a compound machine with a compact constitution, comprises a FAX section (not shown) in addition to a scanner section 4, an automatic document feeder (ADF) 5 and a printer section P. Further, the image forming apparatus 1 comprises a control panel 3, a paper feed cassette section 8, a paper conveyance section 9, a register roller 11, a fixing section 15, a paper discharge sensor 17, a paper discharge roller 19, a paper discharge section (paper discharge tray) 21, a paper reversal conveyance section 23, a controller 25, a storage section 27 and the like The printer section P irradiates, for example, a photoconductive drum 6 serving as an image carrier with the document information stored in, for example, the storage section 27 through a laser exposure unit (not shown) to form an electrostatic latent image on the photoconductive drum 6. Then the electrostatic latent image is developed with the toner in a developer 7 and the toner-developed image is transferred to paper S by a transfer member 13. One end of the paper S is conveyed from the paper feed cassette 8 to the register roller 11 through the paper conveyance section 9, then the paper S is conveyed to a transfer position serving as a nip section between the transfer member 13 and the photoconductive drum 6 at given timing, and then the unfixed toner image on the photoconductive drum 6 is transferred by the transfer member 13. Then, the paper S on which the unfixed toner image is carried is conveyed to the fixing section 15 to be heated and pressed to fix the unfixed toner image on the paper S, and then the paper S is discharged to the paper discharge tray 21 by the paper discharge roller 19.

Further, in a case of duplex image printing, if the paper discharge sensor 17 arranged nearby the paper discharge roller 19 detects the paper S, the paper S is conveyed to the paper reversal conveyance section 23 and then conveyed to a mergence position 12 at the front side of the register roller 11 through the register roller 11 again. The paper S conveyed to the register roller 11 again is conveyed to the transfer position at the given timing, and the unfixed toner image is transferred to the back side of the paper S and then heated, pressed and fixed on the paper S by the fixing section 15. Then the paper S subjected to the fixing processing is discharged to the paper discharge tray 21 by the paper discharge roller 19.

In the present embodiment, color erasable toner serving as developing material of color erasable material is stored in the developer 7. Further, the paper S stored in the paper feed cassette 8 is reuse paper. The reuse paper is paper subjected to printing processing of printing the toner image on the paper with the color erasable toner and the toner image erasing processing, and the erasable toner image is heated and pressed to carry out the erasing processing.

Thus, the reuse paper S is heated and pressed during the image fixing processing of the image heated and pressed at a fixing temperature of the color erasable toner and the image erasing processing based on a color erasing temperature higher than the fixing temperature. Particularly, thermal distortion occurs in the paper in the area where the toner image is formed because the toner image is fused and becomes liquid composition when being heated. The thermal distortion occurring in the paper makes the surface, on which the heated toner image is printed, a contraction side. Thus, the paper S curls with the heated side as the inner side, and generally, four corners of the paper S are likely to curl.

In the present embodiment, a curl suppression image is formed on a surface opposite to the printing surface of the display image with the same color erasable toner as the display image to suppress the curl caused due to the effect of the image (hereinafter referred to as display image) serving as a printing target for display such as the image read by the scanner section 4 or the image output from a personal computer or a USB memory and the like.

Figure 2:
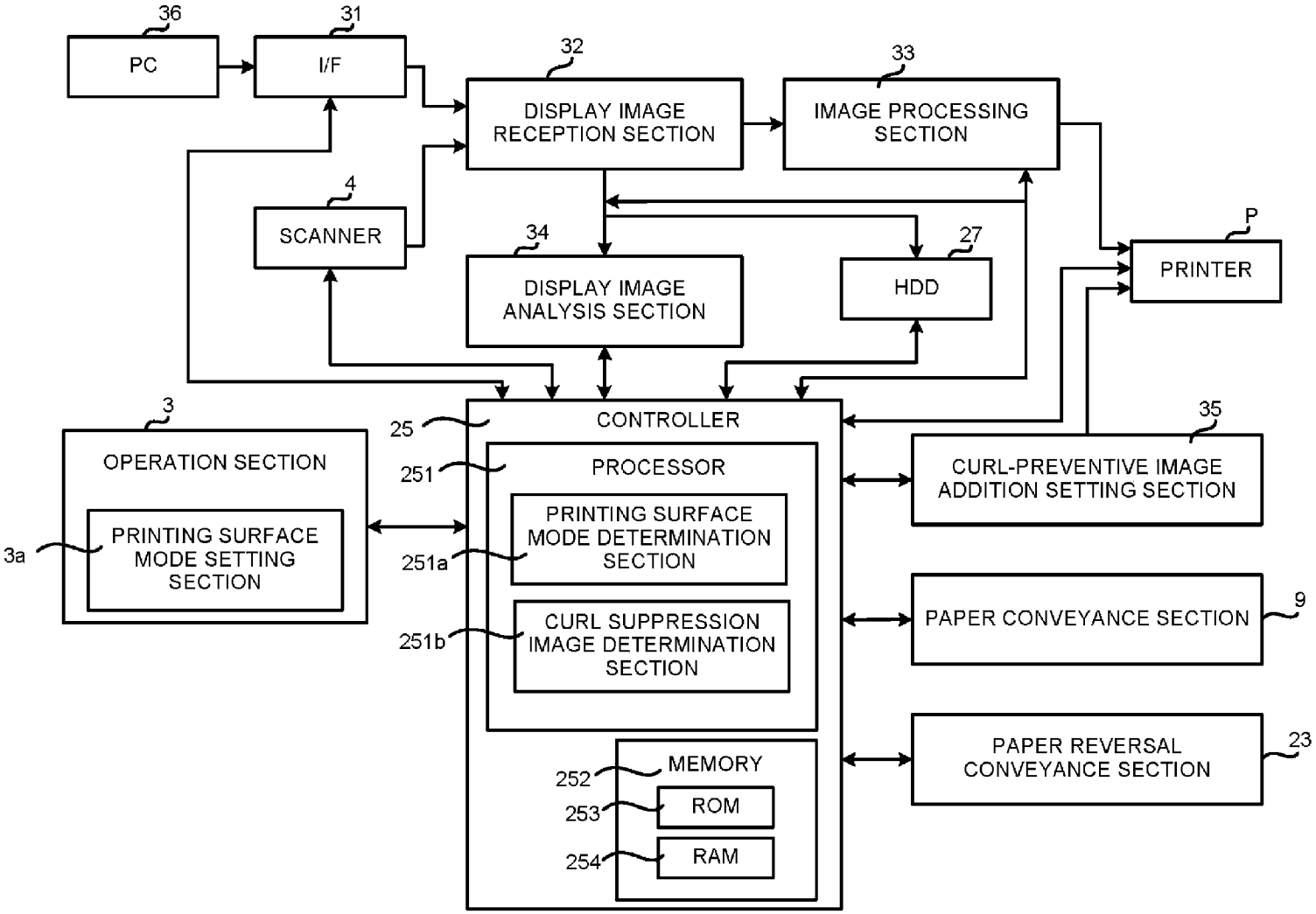
FIG. 2 is a block diagram illustrating the hardware of the image forming apparatus shown in FIG. 1 for carrying out a curl suppression operation.

FIG. 2 is a block diagram illustrating hardware constitution of the image forming apparatus 1.

The controller 25 controlling the whole image forming apparatus 1 is connected with an operation section 3, the scanner section 4, the printer section P and an interface (I/F) 31. The display image information of a personal computer (PC) 36 or the display image information of the scanner section 4 is received by a display image reception section 32. The display image information received by the display image reception section 32 is acquired by an image processing section 33, a display image analysis section 34 and the storage section 27. The display image analysis section 34 analyzes printing range, concentration and density of the display image for each page. The image processing section 33 carries out an image processing on the display image and outputs the resulting data to the printer P.

The operation section 3 includes a printing surface mode setting section 3*a* for setting simplex printing or duplex printing. The printing surface mode of simplex printing or duplex printing set by the printing surface mode setting section of the operation section 3 is sent to the controller 25. Further, the printing surface mode of simplex printing or duplex printing set by the PC 36 is also sent to the controller 25 through the I/F 31.

The controller 25 includes a curl suppression image determination section which determines a printing position and a printing pattern of the curl suppression image for preventing the curl for each page based on the analysis result of the display image analysis section 34. A curl-preventive image addition setting section 35 outputs the curl suppression image information such as the printing position, printing pattern and the like of the curl suppression image determined by the controller 25 to the printer P.

The controller 25 further includes a printing surface mode determination section 251*a* which determines whether the printing surface mode set by the operation section 3 or the PC 36 is simplex printing or duplex printing. In the printing surface mode determination section 251*a*, the printing of the curl suppression image is carried out on the back side if the determined printing surface mode is simplex printing, while no curl suppression measure is taken in a case of duplex printing.

The controller 25 consists of a memory 252 and a processor 251 which includes a CPU (Central Processing Unit) or a MPU (Micro Processing Unit).

The processor 251 includes the printing surface mode determination section (first processor) 251*a* and the curl suppression image determination section (second processor) 251*b*. The method of determining the curl suppression image by the curl suppression image determination section 251*b* is described later (refer to FIG. 4-FIG. 16).

The memory 252, which is, for example, a semiconductor memory, includes a ROM (Read Only Memory) 253 which stores a program for analyzing the printing range, concentration, density and the like of the display image and a program for determining the printing range of the curl suppression image; and a RAM (Random Access Memory) 254 for providing a temporary work area to the processor 251.

In a case of taking curl suppression measures, the controller 25 first drives the paper conveyance section 9 to convey the paper S from the paper feed cassette 8 via the transfer position to the fixing section 15 to fix the color erasable toner image. Next, the controller 25 drives the paper reversal conveyance section 23 to convey the paper S. Then, the curl-preventive image is transferred, at the transfer position, to the back side of the paper S on the single side of which the display image is fixed, and then the curl-preventive image is heated, pressed and fixed on the paper S by the fixing section 15.

That is, if the display image is fixed on the paper S, the paper S curls due to the thermal distortion as stated above. However, if the curl-preventive image is fixed, the thermal distortion occurs to curl the paper in an opposite direction, therefore, the curl is offset, and as a result, the occurrence of curl is suppressed.

On the other hand, in a case of carrying out color erasing processing to reuse the paper S on which the curl-preventive image is printed, if the single side and the back side are heated and pressed simultaneously as in the fixing processing, the curls occurring in the both sides of the paper S are offset, therefore, the occurrence of curl is suppressed.

The relation between the display image and the curl suppression image is exemplified in FIG. 4-FIG. 12. In addition, the surface of the paper S on which a display image 51 is printed is referred to as a first surface S1, and the surface on which a curl suppression image 52 is printed is referred to as a second surface S2. In FIG. 4-FIG. 11, the direction of the printing of the paper S is vertical, while in FIG. 12, the direction of the printing of the paper S is horizontal.

Figure 4:
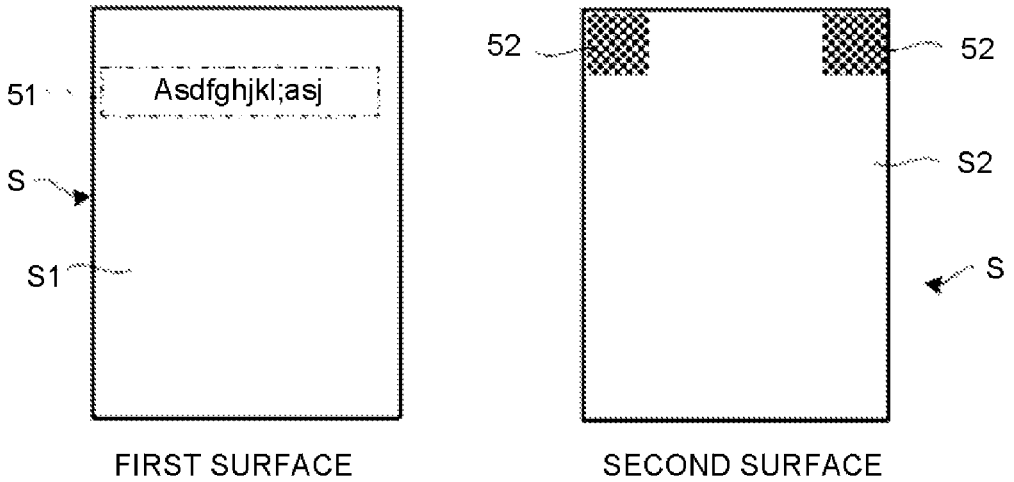
FIG. 4 is a diagram illustrating a printing range and a printing pattern of a curl suppression image in a case where a display image with low density is printed at the upper half part of a paper.

FIG. 4 shows a case in which the printing range of the display image 51 on the first surface S1 of the paper S is the upper half part of the figure and the image density is low. In this case, on the second surface S2 of the paper S, the curl suppression image 52 is printed at both corners of the upper part of the paper S in the figure.

Figure 5:
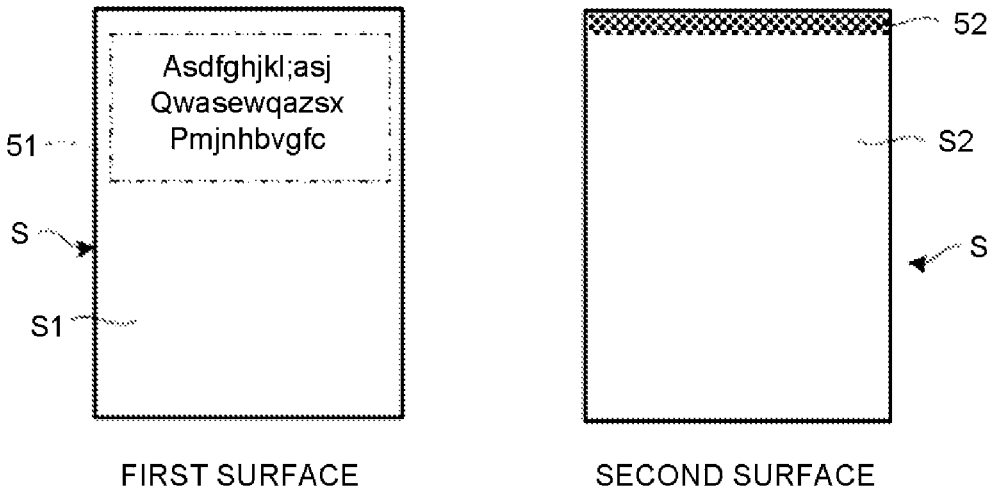
FIG. 5 is a diagram illustrating the printing range and the printing pattern of the curl suppression image in a case where a display image with high density is printed at the upper half part of the paper.

FIG. 5 shows a case in which the printing range of the display image 51 on the first surface S1 of the paper S is the upper half part of the paper S in the figure and the image density is high. In this case, on the second surface S2 of the paper S, the curl suppression image 52 is printed in a belt shape along a lateral direction at the upper end part of the paper S in the figure.

Figure 6:
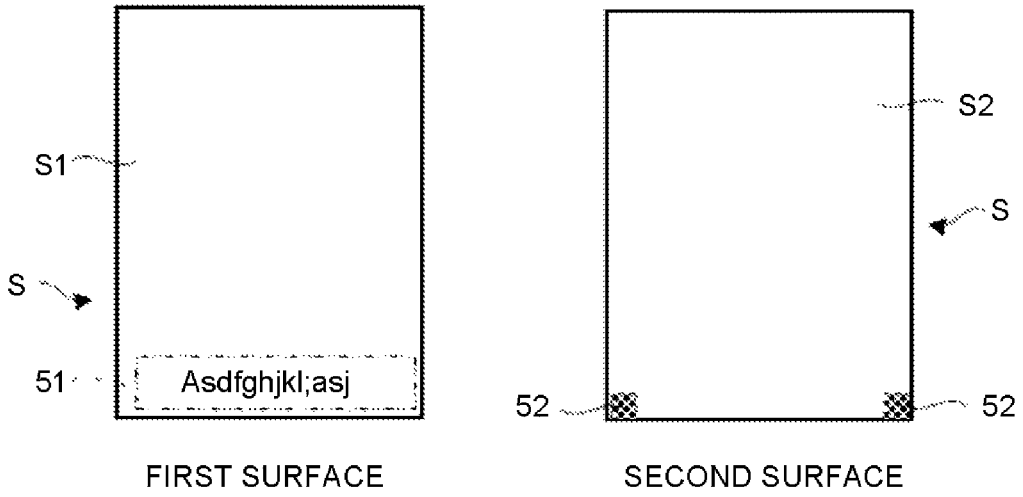
FIG. 6 is a diagram illustrating the printing range and the printing pattern of the curl suppression image in a case where a display image with low density is printed at the lower half part of the paper.

FIG. 6 shows a case in which the printing range of the display image 51 on the first surface S1 of the paper S is the lower half part of the paper S in the figure and the image density is low. In this case, on the second surface S2 of the paper S, the curl suppression image 52 is printed at both corners of the lower part of the paper S in the figure.

Figure 7:
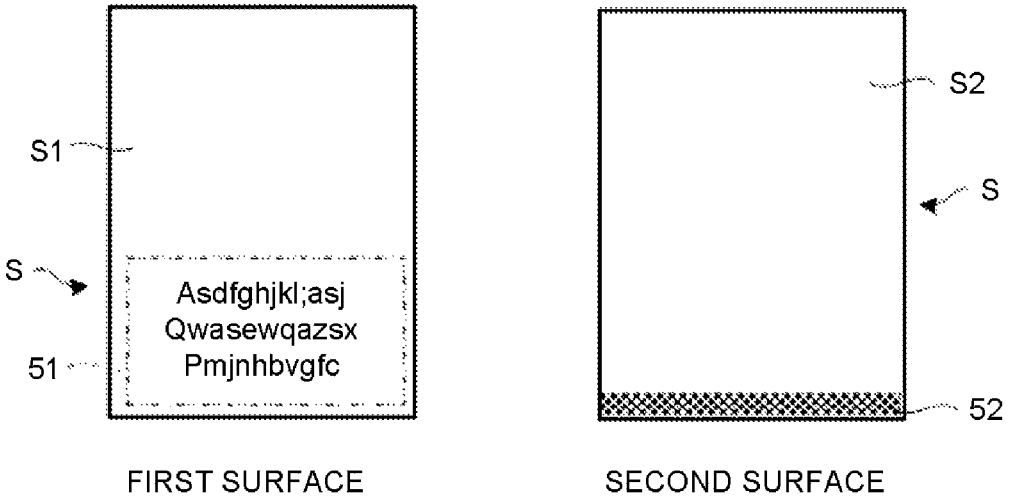
FIG. 7 is a diagram illustrating the printing range and the printing pattern of the curl suppression image in a case where a display image with high density is printed at the lower half part of the paper.

FIG. 7 shows a case in which the printing range of the display image 51 on the first surface S1 of the paper S is the lower half part of the paper S in the figure and the image density is high. In this case, on the second surface S2 of the paper S, the curl suppression image 52 is printed in a belt shape along a lateral direction at the lower end part of the paper S in the figure.

Figure 8:
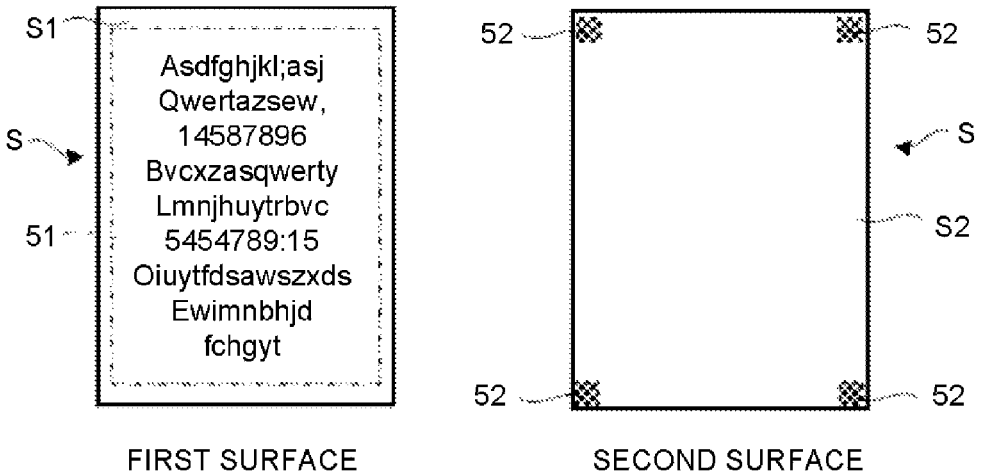
FIG. 8 is a diagram illustrating the printing range and the printing pattern of the curl suppression image in a case where a display image with low density is printed on the whole paper.

FIG. 8 shows a case in which the printing range of the display image 51 on the first surface S1 of the paper S is the whole paper S and the image density is low. In this case, on the second surface S2 of the paper S, the curl suppression image 52 is printed at each of the four corners of the paper S.

Figure 9:
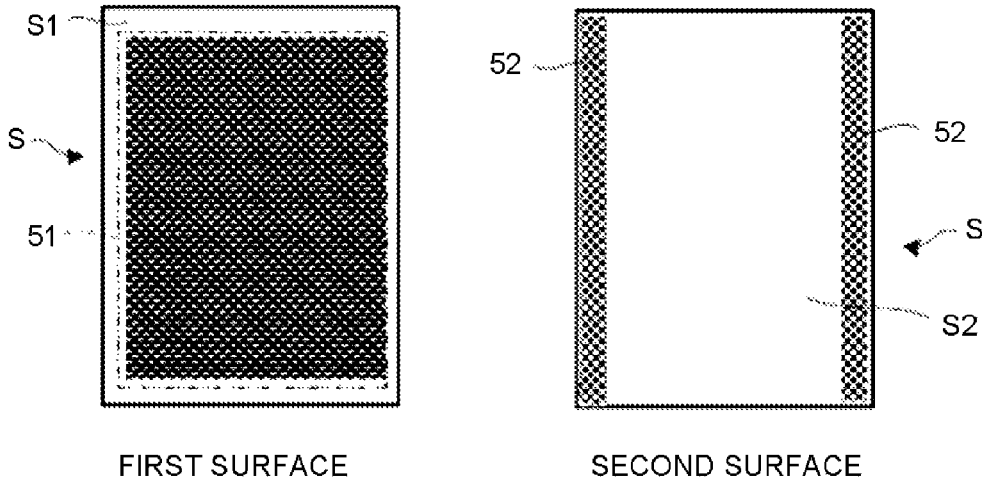
FIG. 9 is a diagram illustrating the printing range and the printing pattern of the curl suppression image in a case where a display image with high density is printed on the whole paper.

FIG. 9 shows a case in which the printing range of the display image 51 on the first surface S1 of the paper S is the whole paper S and the image density is high. In this case, on the second surface S2 of the paper S, the curl suppression image 52 is printed in a belt shape along a longitudinal direction at both sides of the lateral direction of the paper S.

Figure 10:
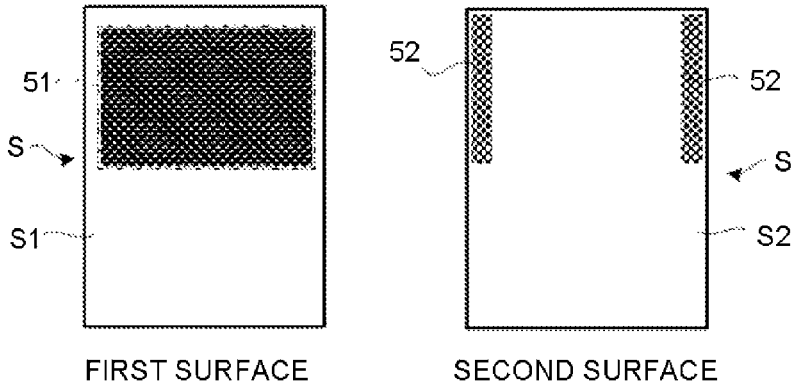
FIG. 10 is a diagram illustrating another printing range and printing pattern of the curl suppression image in a case where a display image with high density is printed at the upper half part of the paper.

FIG. 10 shows a case in which the printing range of the display image 51 on the first surface S1 of the paper S is the upper half part of the paper S in the figure and the image density is high. In this case, on the second surface S2 of the paper S, the curl suppression image 52 is printed in a belt shape at both sides of the lateral direction of the paper S for a length equal to the length of the display area of the display image 51 in the longitudinal direction.

Figure 11:
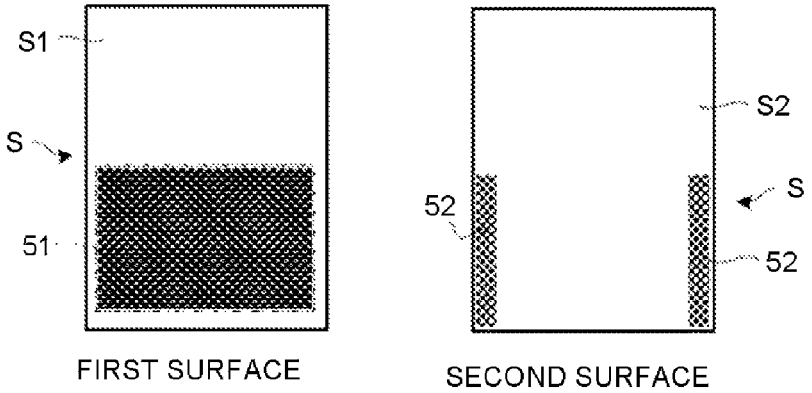
FIG. 11 is a diagram illustrating another printing range and the printing pattern of the curl suppression image in a case where a display image with high density is printed at the lower half part of the paper.

FIG. 11 shows a case in which the printing range of the display image 51 on the first surface S1 of the paper S is the lower half part of the paper S in the figure and the image density is high. In this case, on the second surface S2 of the paper S, the curl suppression image 52 is printed in a belt shape at both sides of the lateral direction of the paper S for a length equal to the length of the display area of the display image 51 in the longitudinal direction.

Figure 12:
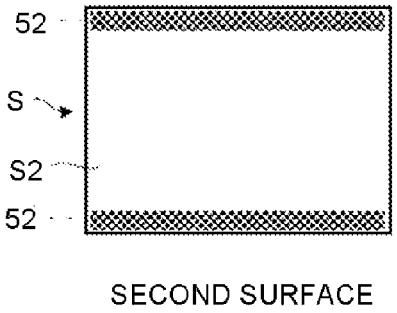
FIG. 12 is a diagram illustrating another printing range and printing pattern of the curl suppression image in a case where the direction of the printing of the paper is horizontal.

FIG. 12 shows a print example of the curl suppression image 52 in a case where the printing direction of the paper S is horizontal. In a case of horizontal printing, the long sides are likely to curl. Thus, on the second surface S2 of the paper S, the curl suppression image 52 is printed in a belt shape along the long side at one or two sides of the lateral direction of the paper S.

In FIG. 4-FIG. 12 described above, if the concentration of the display image 51 is high, the concentration of the curl suppression image 52 is also set to be high; on the contrary, if the concentration of the display image 51 is low, the concentration of the curl suppression image 52 is set to be low as well.

In a case of printing the display image 51 on the first surface S1 of the paper S only, the controller 25 selects a method for printing the curl suppression image 52 on the second surface S2 according to the printing range, the concentration and the density of the display image 51.

Next, the curl suppression processing carried out by the controller 25 is described with reference to the flowchart shown in FIG. 3.

If the printing of the display image is instructed by the personal computer (PC) 36 or the scanner 4, the printing surface mode is confirmed and it is determined whether or not the printing of the display image instructed to be printed is simplex printing in ACT 1; if it is determined to be simplex printing (YES in ACT 1), ACT 2 is taken; and if it is not simplex printing (NO in ACT 1), for example, if it is duplex printing, the curl suppression processing is ended. That is, in a case in which the printing surface mode is set to be duplex printing, the paper S is less likely to curl, thus, the printing is carried out without executing the curl suppression processing. In a case in which the printing surface mode is set to be simplex printing, the content of the display image 51 acquired by the display image reception section 32 is analyzed by the display image analysis section 34.

In ACT 2, it is determined whether or not the printing range of the display image 51 on the first surface S1 of the paper S is the upper half part of the paper S in the longitudinal direction, and ACT 3 is taken if it is the upper half part of the paper S (YES in ACT 2), and ACT 6 is taken if it is not the upper half part of the paper S (NO in ACT 2).

In ACT 3, it is determined whether or not the image density of the display image 51 is high, and ACT 4 is taken if the image density is high ("Hi" in ACT 3) and ACT 5 is taken if the image density is low ("Lo" in ACT 3).

In ACT 4, the printing position and the printing pattern of the curl suppression image 52 is determined, and then the curl suppression processing is ended. In this case, as shown in FIG. 5, the printing position is at the upper part of the second surface of the paper S and the printing pattern of the curl suppression image 52 is a belt shape along the short side. The printing density is determined according to the percentage of the printed part/non-printed part by viewing the pixels in the printing range of the display image 51. In addition, the printing position and the printing pattern of the curl suppression image 52 may be set as shown in FIG. 10.

In ACT 5, the printing position and the printing pattern of the curl suppression image 52 is determined, and then the curl suppression processing is ended. In this case, as shown in FIG. 4, the printing position is at the two corners of the upper part of the second surface of the paper S, and the printing pattern of the curl suppression image 52 is a square.

In ACT 6, it is determined whether or not the printing range of the display image 51 is the lower half part of the paper S in the longitudinal direction, and ACT 7 is taken if it is the lower half part of the paper S (YES in ACT 6), and ACT 10 is taken if it is not the lower half part of the paper S (NO in ACT 6).

In ACT 7, it is determined whether or not the image density of the display image 51 is high, and ACT 8 is taken if the image density is high ("Hi" in ACT 7) and ACT 9 is taken if the image density is low ("Lo" in ACT 7).

In ACT 8, the printing position and the printing pattern of the curl suppression image 52 is determined, and then the curl suppression processing is ended. In this case, as shown in FIG. 7, the printing position is at the lower part of the second surface of the paper S and the printing pattern of the curl suppression image 52 is a belt shape along the short side. In addition, the printing position and the printing pattern of the curl suppression image 52 may be set as shown in FIG. 11.

In ACT 9, the printing position and the printing pattern of the curl suppression image 52 is determined, and then the curl suppression processing is ended. In this case, as shown in FIG. 6, the printing position is at the two corners of the lower part of the second surface of the paper S, and the printing pattern of the curl suppression image 52 is a square.

In ACT 10, it is determined whether or not the printing range of the display image 51 is the whole paper S, and ACT 11 is taken if it is the whole paper S (YES in ACT 10), and the curl suppression processing is ended if it is not the whole paper S (NO in ACT 10).

In ACT 11, it is determined whether or not the image density of the display image 51 is high, and ACT 12 is taken if the image density is high ("Hi" in ACT 11) and ACT 13 is taken if the image density is low ("Lo" in ACT 11).

In ACT 12, the printing position and the printing pattern of the curl suppression image 52 is determined, and then the curl suppression processing is ended. In this case, as shown in FIG. 9, the printing position is at the two sides of the lateral direction of the second surface of the paper S and the printing pattern of the curl suppression image 52 is a belt shape along the long side.

In ACT 13, the printing position and the printing pattern of the curl suppression image 52 is determined, and then the curl suppression processing is ended. In this case, as shown in FIG. 8, the printing position is at the four corners of the second surface of the paper S, and the printing pattern of the curl suppression image 52 is a square.

Figure 3:
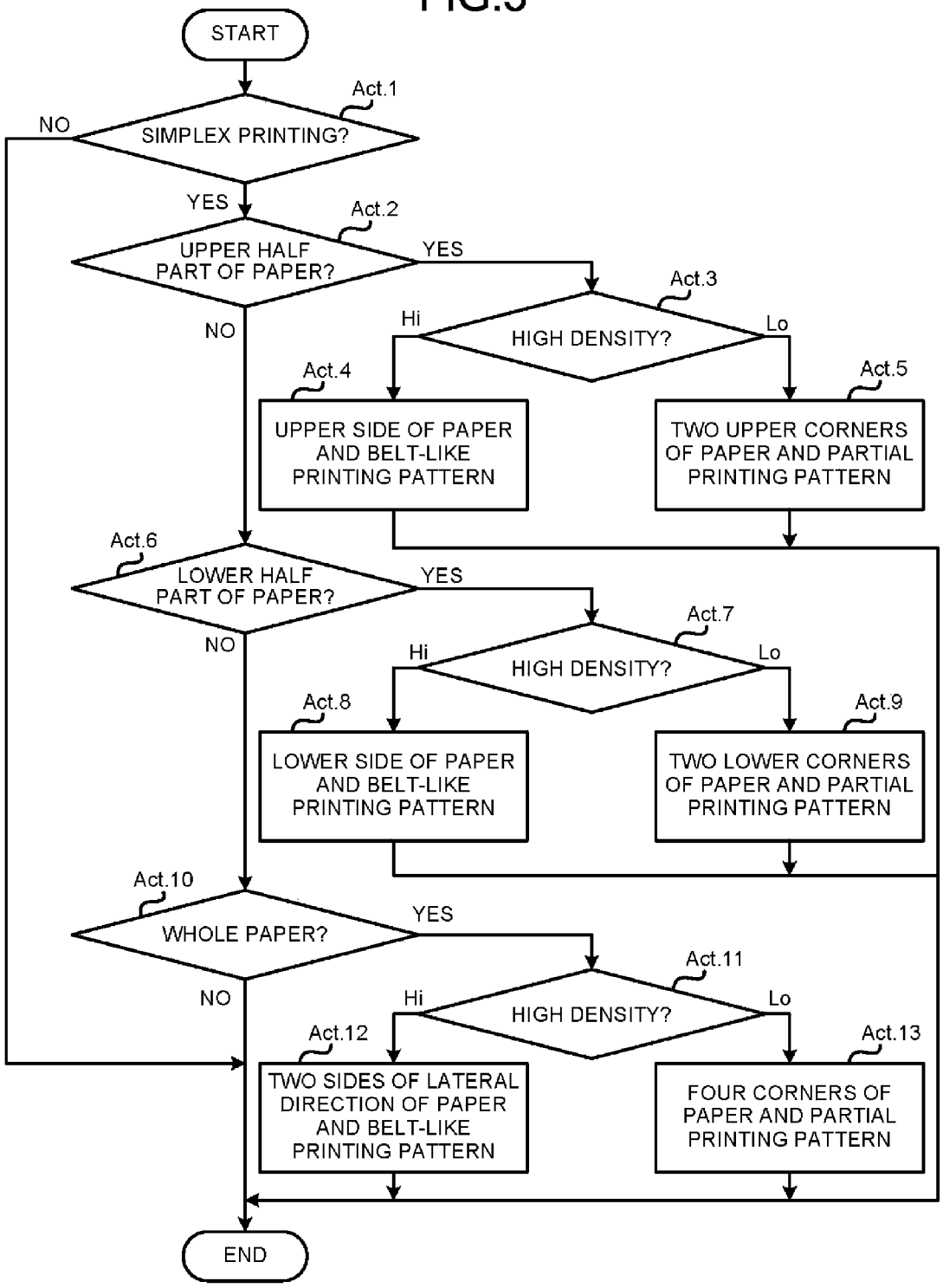
FIG. 3 is a flowchart illustrating the curl suppression operation based on the hardware shown in FIG. 2.

Though the concentration adjustment of the curl suppression image 52 is not described in the flowchart shown in FIG. 3, after the printing pattern of the curl suppression image 52 is determined, the printing concentration of the display image 51 is analyzed and the concentration of the printing pattern of the curl suppression image 52 is adjusted according to the printing concentration of the display image 51. As to the method of adjusting the printing concentration of the curl suppression image 52, the printing concentration of the curl suppression image 52 may be set to be the same as that of the display image 51, alternatively, the printing concentration of the curl suppression image 52 may be set to be a little higher than that of the display image 51.

Then, the printing pattern of the curl suppression image 52 determined through these processing is instructed to the printer P by the curl-preventive image addition setting section 35, and then the curl suppression image 52 is printed on the second surface S2 of the reversed paper S after the display image 51 is printed on the first surface S1 of the paper S.

Thus, in accordance with the present embodiment, the occurrence of the curl of the paper corners and the curl of the long sides can be suppressed without using a new device or material to cope with the curl.

Figure 13:
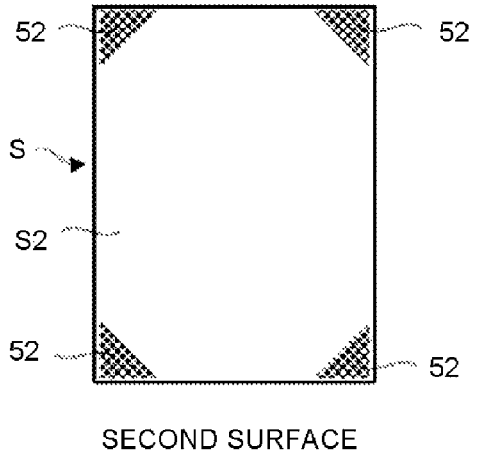
FIG. 13 is a diagram illustrating an embodiment in which the printing pattern of the curl suppression image is a triangle.

In the embodiment described above, the printing pattern for printing the curl suppression image 52 at the corners of the paper S is set to be a square; however, as shown in FIG. 13, the printing pattern of the curl suppression image 52 may also be a triangle. In this case, the consumption of the toner serving as color erasable material of the curl suppression image 52 can be reduced. The curl suppression image 52 printed at corners of the paper S may be of any form (a polygonal shape such as a square or a triangle; a graph such as a circle; characters; or numbers and the like) as long as it can be fitted into the corner of the paper S.

Figure 14:
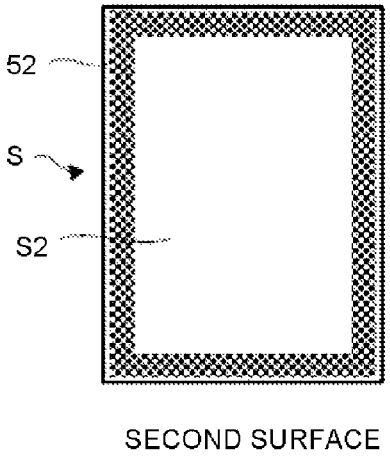
FIG. 14 is a diagram illustrating the printing range and the printing pattern of the curl suppression image in a case where a display image with high density and concentration is printed on the whole paper.

Further, in a case where the printing range of the display image 51 on the first surface S1 of the paper S is large and the printing density and the concentration are high, a printing pattern shown in FIG. 14 can be used to print the curl suppression image 52 in a belt shape along the four sides of the second surface S2.

Figure 15:
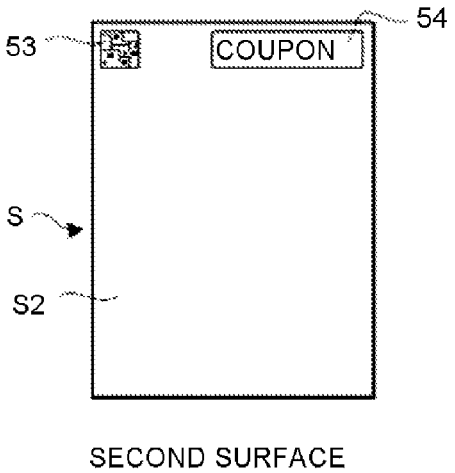
FIG. 15 is a diagram illustrating a printing range and a printing pattern in a case where the curl suppression image is a coupon.

For the sake of the user who is opposed to consume extra toner for coping with the curl, as shown in FIG. 15, a curl suppression image 54 used as a coupon may be printed, alternatively, the curl suppression image 54 used as a coupon and a curl suppression image 53 serving as a two-dimensional barcode may be printed. The color erasable toner for forming the curl suppression images 52, 53 and 54 is consumed regardless of the original intention of the user. Thus, before the color erasing processing, the curl suppression images 53 and 54 are scanned and stored in a storage section as the toner consumption point of the curl suppression image. Through the use of the toner consumption point, some profits can be returned to the user.

Figure 16:
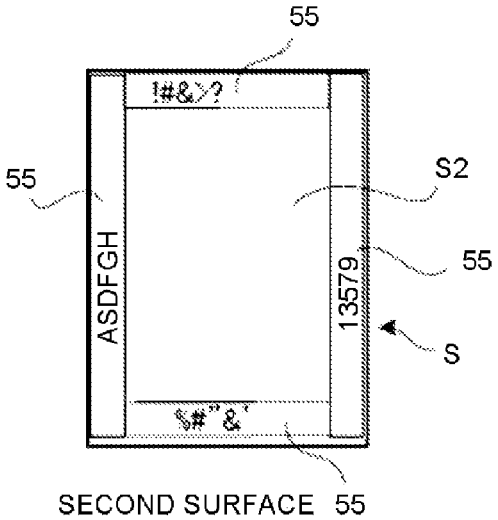
FIG. 16 is a diagram illustrating a printing range and a printing pattern in a case where the curl suppression image is an advertisement.

Further, as shown in FIG. 16, an advertisement 55 may be printed as the curl suppression image.

In addition, the images of the coupon 54 and the advertisement 55 may be registered in different variations, and the coupons and advertisements to be printed can be used properly according to the concentration and the printing range of the curl suppression image.

In the present embodiments, any of the processes described above can be accomplished by a computer-executable program, and this program can be embodied in a non-transitory computer-readable memory device. In the embodiments, the memory device, such as a magnetic disk, a flexible disk, a hard disk, an optical disk (CD-ROM, CD-R, DVD, and so on), an optical magnetic disk (MD and so on) can be used to store instructions for causing a processor or a computer to perform the processes described above. Furthermore, based on an instruction in the installed program, an OS (operating system) of the computer, or MW (middleware software), such as database management software or network, may execute one or more parts of the processes described above to realize the embodiments.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus for printing a display image serving as a printing target for display on paper with color material, comprising:

a printing surface mode determination section configured to determine whether or not a printing surface of the display image is simplex printing;

a printer configured to print the display image on a first surface of paper in a case of simplex printing;

a display image analysis section which analyzes a printing range and a density of the display image;

a curl suppression image determination section configured to determine, if the display image is simplex printing, a printing position and a printing pattern of a curl suppression image for suppressing a curl of the paper caused by the display image based on an analysis result of the display image analysis section; and a curl-preventive image addition setting section configured to set image information of the printing position and the printing pattern of the curl suppression image which is determined by the curl suppression image determination section and is to be printed on a second surface of the paper, wherein the printer prints the curl suppression image with color erasable material.

2. The image forming apparatus according to claim 1, wherein the display image analysis section further analyzes a concentration of the display image.

3. The image forming apparatus according to claim 1, wherein the curl suppression image determination section determines the printing position of the curl suppression image including the corner parts of the paper.

4. The image forming apparatus according to claim 1, wherein the curl suppression image determination section determines the printing pattern of the curl suppression image to be a coupon or an advertisement.

5. The image forming apparatus according to claim 1, wherein the printer section, which is an electrophotographic type printer, transfers the display image formed with color erasable toner to the paper through a transfer section, heats and presses the display image formed with color erasable toner through a fixing section to fix the display image on the first surface of the paper, conveys the paper on the first surface of which the display image is fixed to the transfer section through a reversal conveyance section, and then prints the curl suppression image on the second surface of the paper.

6. An image forming method for printing a display image serving as a printing target for display on paper with color erasable material, including:

determining whether or not the display image is to be subjected to simplex printing;

analyzing a printing range and density of the display image if the display image is determined to be simplex printing;

determining a printing position and a printing pattern of a curl suppression image for suppressing a curl of the paper caused by the display image based on the printing range and density of the display image;

printing the display image on a first surface of the paper in a case of simplex printing; and printing the curl suppression image on a second surface of the paper with color erasable material according to the determined printing position and printing pattern.

7. The image forming method according to claim 6, further including:

analyzing a concentration of the display image and determining a concentration of the curl suppression image according to the concentration of the display image.

* * * * *